United States Patent [19]

Ozawa

[11] 4,031,870

[45] June 28, 1977

[54] FUEL CHARGE INJECTION APPARATUS FOR INTERNAL COMBUSTION ENGINES

[75] Inventor: Shinji Ozawa, Kanagawa, Japan

[73] Assignee: Mikuni Kogyo Co., Ltd., Tokyo, Japan

[22] Filed: Mar. 20, 1975

[21] Appl. No.: 560,170

[52] U.S. Cl. ..... 123/119 R; 123/139 AW; 123/DIG. 10; 261/DIG. 69; 137/824

[51] Int. Cl.[2] ..... F02B 33/00; F02M 7/00; F02D 11/08; F02M 17/02

[58] Field of Search ... 123/119 R, 139 AW, DIG. 10; 261/DIG. 69; 137/824

[56] References Cited

UNITED STATES PATENTS

| | | | |
|---|---|---|---|
| 3,272,215 | 9/1966 | Bjornsen et al. | 137/824 |
| 3,417,769 | 12/1968 | Bjornsen et al. | 137/824 |
| 3,426,780 | 2/1969 | Gray | 137/824 |
| 3,499,458 | 3/1970 | Korta et al. | 137/824 |
| 3,548,794 | 12/1970 | Lazar | 123/DIG. 10 |
| 3,556,063 | 1/1971 | Tuzson | 123/DIG. 10 |
| 3,616,782 | 11/1971 | Matsui et al. | 261/DIG. 69 |
| 3,695,245 | 10/1972 | Ishida | 123/140 MC |
| 3,696,828 | 10/1972 | Bjornsen | 137/824 |
| 3,874,352 | 4/1975 | Ishida | 123/DIG. 10 |

*Primary Examiner*—Wendell E. Burns
*Attorney, Agent, or Firm*—Andrus, Sceales, Starke & Sawall

[57] ABSTRACT

A fluidic fuel charge injection device for an internal combustion engine includes an impacting stream device having a deflection control nozzle and a control chamber enclosing a main stream nozzle. The device is mounted in the engine manifold to introduce the fuel charge. The device operates at high pressure levels and the control signals are amplified to the necessary power level. An engine revolutional signal is a modulated pulse width signal formed by triggering of high power level fluidic amplifying devices which include a plurality impacting stream fluidic operating as NOR logic elements. An amplifying section includes a transverse impact modulator follower (TIMF) connected to the logic output to produce a pair of interrelated fluid signals proportional to the engine RPM. The pair of signals are applied to the control chambers or through a fluidic coupling stage to a control chamber or to the main stream nozzle for controlling the air-fuel mixture and the introduction of the charge into the manifold.

12 Claims, 9 Drawing Figures

FUEL CHARGE INJECTION APPARATUS FOR INTERNAL COMBUSTION ENGINES

BACKGROUND OF THE INVENTION

The present invention relates to a fluidic charge injection apparatus employing fluidic amplifying and logic devices to process air and fuel signals to form a fuel-air charge for an internal combustion engine.

Highly satisfactory fuel injection devices for internal combustion engines have been developed employing an impacting stream fluidic device mounted within the manifold as the charge injection means. The impacting fluidic device has a pair of opposing impacting streams which function to atomize or pulverize the air and fuel streams within the manifold and thereby produce the desired mixture or fuel charge. Systems employing transverse impact modulators (TIM) and/or summing impact modulators (SIM) have provided highly satisfactory fuel forming charge systems. For example, U.S. Pat. No. 3,695,245 to Ishida and the pending U.S. application Ser. No. 284,555, filed on Aug. 29, 1972 and assigned to the same assignee as the present application disclose such fluidic charge injection devices. Further, the above references disclose sensing systems for modulating and controlling the introduction and mixture of the fuel-air charge. For example- the revolutions per minute (RPM) of the engine are detected and generate a engine revolutional-number function signal which is coupled into a computing system for controlling the fuel charge injection. Generally, a cam driven signal generator operates a "one shot" signal device. The fluidic "one shot" device generally is disclosed as a plain fluidic element which is operable to generate a pulse type trigger signal to the fluid injection device mounted within the manifold. The plain fluidic device is generally a two-dimensional device in which the streams are confined between a pair of parallel members and interact or collide within a chamber having confining sidewalls such that the output signals are derived in a single plane, and the input signals are similarly developed in a single plane. Generally, the signal processing devices operate at low power levels and the charge injection device is therefore operated at a correspondingly low level. Although such systems have been widely employed, the present Applicant has found significant improvement in the charge injection results if the charge injection device within the manifold is operated at significantly higher power levels, as presently disclosed.

SUMMARY OF THE INVENTION

The present invention is directed to a fluidic fuel charge injection device operating at high power levels and employing high gain three-dimensional fluidic devices for generating of the input signals to thereby permit the operation of the total system at high power levels and particularly on the order of the output signal for controlling of the fuel charge injection of the internal combustion engine. The system of this invention permits the generation of high level control signals thereby increasing the power level of the fuel and air signals to be intermixed within the charge injection device. Generally, in accordance with one novel feature of the present invention, the charge injection device includes a pair of stream control signal inputs, at least one of which is concentric with one of the main impacting streams. Applicant has found that the injected charge is significantly improved in uniformity and significantly stabilized by employing high power levels in accordance with the teaching of the present invention. A pulse signal having a modulated width proportional to the revolutional signal is preferably developed for controlling of the charge injection device within the manifold. In accordance with a further certain novel aspect of the invention, the modulated pulse width is generated by high power level fluidic devices and particularly including an impacting stream fluidic follower device.

In a preferred and unique construction of the present invention, a fluid control signal is generated in any suitable revolution detection system. A fluidic follower, preferably a transverse impct modulator follower (TIMF), is connected to form at least a pair of interrelated fluid signals proportional to the engine RPM. The input signal is simultaneously applied to a pair of streams of the three-dimensional impacting stream charge injection device mounted within the manifold for supplying of the fuel charge to the internal combustion engine. This permits operating of the fluidic device of the charging device at a relatively high power level. The RPM controls signal is uniquely generated by developing a plurality of fluid signals which are interconnected to impacting stream logic gates to raise the power level and for converting of the analog pressure signals to a pulse signal of a time width which is a function of the number of revolutions of the engine. An extremely satisfactory system employs a first pair of two input transverse impacting stream logic devices functioning as NOR logic elements and interconnected to form a flip-flop "one shot" control unit. The output of the flip-flop unit is coupled to a third two-input transverse impacting stream logic device functioning as subtracting NOR logic element. This third device receives a signal from the RPM detection unit which is subtracted from the "one shot" circuit to generate a pulse signal of a width proportional to RPM. The pulse signal is coupled to the fluidic charge injection device through a fluidic power amplifier to increase the power level of the control signals and produces a pair of high power level control signals. The pulse width signal is preferably simultaneously applied to control the strength of at least one of the main power streams of the impacting charge injection device within the manifold and in a preferred construction to control the injection time.

The present invention, thus, provides for increasing of the control signals to a relatively high power level and the operating of the charge injection at such higher power level with an effective increase in the uniformity and stabilization of the charge introduced with an improved overall efficiency of the charge injection system.

The present invention, thus, provides an improved fluidic fuel injection system producing a more uniform and stabilized fuel charge to the internal combustion engine.

BRIEF DESCRIPTION OF THE DRAWING

The drawing furnished herewith illustrate a preferred construction of the present invention in which the above advantages and features are clearly disclosed, as well as others, which will be readily understood from the following description.

In the drawing.

DESCRIPTION OF ILLUSTRATED EMBODIMENTS

Figure 1A:
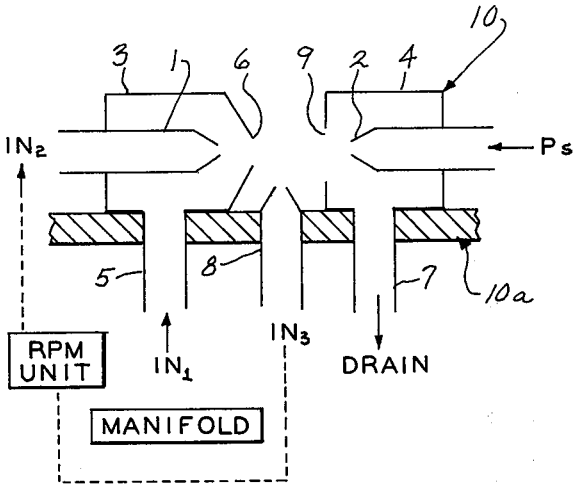
FIG. 1A is a diagrammatic illustration of a fluidic impacting stream fuel injection device mounted within a manifold for an internal combustion engine for purposes of clearly explaining the functioning of the present invention.

Referring to the drawings and particularly to FIG. 1A, a fuel injection device 10 of an impacting stream concept or construction is mounted within an engine manifold 10*a* for supplying of an air-fuel charge to the internal combustion engine, not otherwise shown. The charge injection device 10 generally includes an air nozzle 1 which is coupled to a pressurized air source IN2 to develop a stream of air or a mixture of air and fuel which impacts with an opposing stream generally of fuel only from an opposing stream generally of fuel only from a opposing fuel nozzle 2 connected to a fuel supply Ps. Nozzles 1 and 2 are mounted in mutually opposed coaxial alignment. The air and fuel streams are selected to impact within a drain chamber 4 mounted in encircling relationship to the outer orifice of the fuel nozzle 2 and having a drain port 7 for returning the fuel to the supply. In accordance with the illustrated embodiment of the invention shown in FIG. 1A, a control signal nozzle 6 is concentrically mounted with respect to the nozzle 1 and connected to a signal source by an input port 5 for controlling the strength of the air stream from nozzle 1. An on-off control nozzle 8 is orthogonically mounted between nozzles 1 and 2 as well as the chambers 3 and 4 and connected to a signal source such as an engine RPM signal generator to selectively reduce the strength of the air stream. As disclosed in the above patent, the impact position then moves outwardly of the drain chamber 4 to effect impact within the manifold chamber of the impacting stream device within maifold 10*a* for introducing of a corresponding air-fuel charge into the manifold.

The present invention employs a second control signal, such as the manifold pressure related signal of the above patent, uniquely applied concentrically of one of the main air-fuel streams, shown by chamber 3 enclosing the air stream nozzle 1 in FIG. 1A. The dual signal control is impressed on the charge injection device, with the power of the main streams emitted from nozzles 1 and 2 increased such that the charge injection is produced at a high power level. Thus, Applicant has found that the pressure level can be readily raised to a pressure level of ten pounds per square inch (psi) and a flow rate of ninety-three cubic feet per minute (fpm).

Figure 2A:
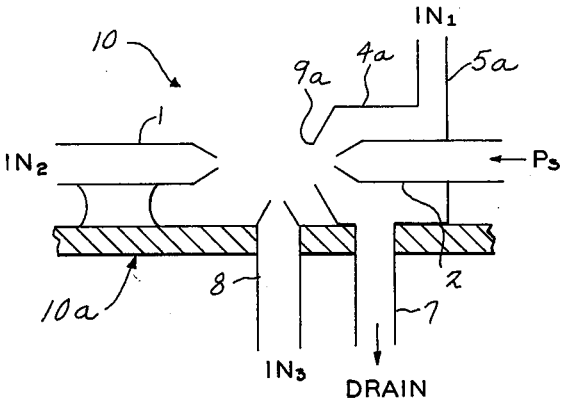
FIG. 2A is a view similar to FIG. 1A illustrating a further embodiment constructed in accordance with the teaching of the present invention.

In the drawings, FIG. 2A illustrates an aternative embodiment of a fluidic impacting device, particularly adapted to incorporation as the fluidic charge injection device in accordance with the teaching of the present invention. As in FIG. 1A, the injection device includes a pair of opposing nozzles 1 and 2 with the control nozzle 8 located to engage the air stream introduced by nozzle 1. In the embodiment of FIG. 2A, a single encircling chamber 4*a* is mounted concentrically of the nozzle 2 with a control orifice 9*a* concentrically aligned with the orifice of the nozzle 2 to define a control chamber about the end of nozzle 2. The chamber 4*a*, has a signal input port 5*a* and a drain port 7 such that the chamber simultaneously functions as an input-output or pass-through chamber.

As a fluidic injection device 10, the port 5*a* is connected to an engine related function control signal and the port 7 is connected as a drain to return fuel to the supply generally in accordance with the functioning of chamber 4. In the embodiment of FIG. 2A, however, the signal pressure applied via port 5*a* will directly modify the effective strength of the fuel supplied by nozzle 2 and thereby, correspondingly affect the impacting position of the fuel and air streams with respect to the manifold chamber.

Figure 1B:
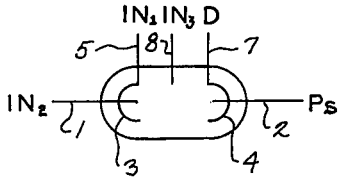
FIG. 1B is a schematic illustration of the injection device shown in FIG. 1A and employed in the schematic illustration of FIGS. 3 and 4.
Figure 2B:
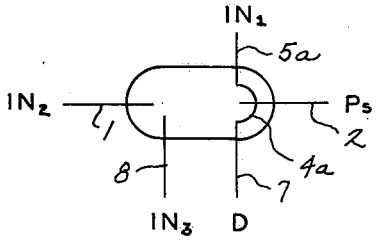
FIG. 2B is a schematic illustration of the injection charge device shown in FIG. 2A and employed in the schematic circuits of FIGS. 5–7, inclusive.

A fluidic device generally constructed in accordance with the embodiment of FIG. 2A may function as a transverse impact modulator follower. FIGS. 1B and 2B are line illustrations of the unit shown in 1A and 2A and are employed in FIGS. 3–7 to illustrate devices similarly constructed. Thus, the nozzles 1, 2 and 8 are shown by line illustrations while the chamber 4*a* is shown by a semi-circular line about the end of the fuel supply nozzle with the interconnecting ports also shown by line drawings.

In order to separate the charge injection devices at the high power levels, the input control signals supplied at ports 5, 5*a* and 8 of the charge injection device 10 must, of course, be of a corresponding interrelated power level. In accordance with the present invention, the output signals from the detection units are applied to suitable impacting stream amplifying devices to increase the power level of the relatively weak fluidic signals to the necessary power level for controlling of the high pressure main streams of the fluidic charge injection device. A unique signal amplifying and processing system is shown in FIG. 3 employing the impacting device of FIGS. 1A and 1B, with modification of FIG. 4 and the impacting device of FIGS. 2A and 2B shown in FIGS. 5–7.

Figure 3:
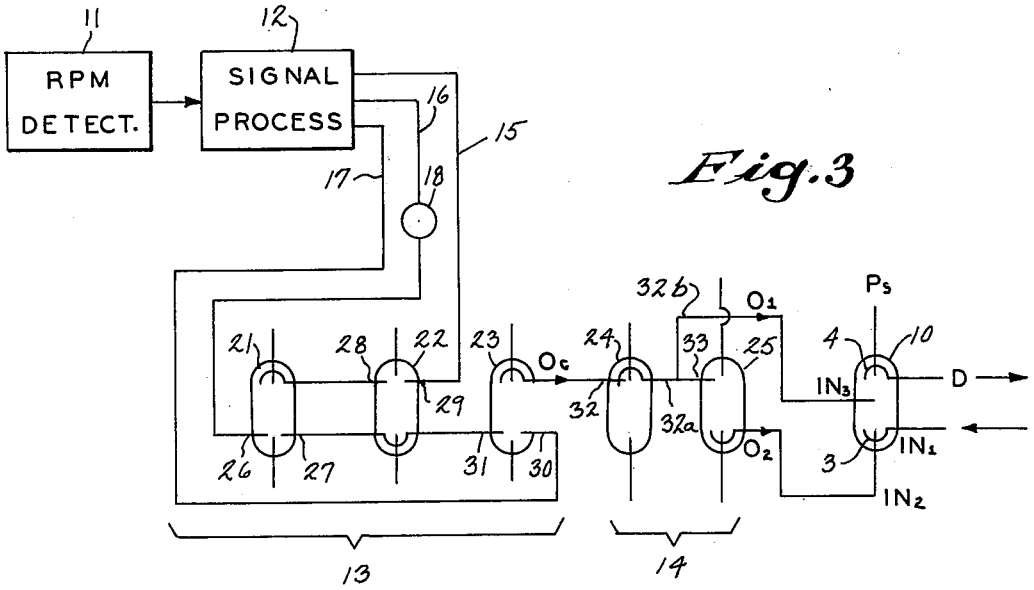
FIG. 3 is a schematic illustration of an embodiment of the invention employing a novel fluidic pulse width modulating system and a charge injection device as shown in FIGS. 1A and 1B.
Figure 4:
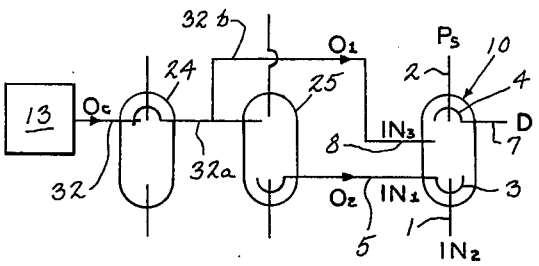
FIG. 4 illustrates modification of the embodiment shown in FIG. 3 with different control signals.

Referring particularly to FIGS. 3 and 4, an embodiment of the present invention is illustrated incorporating the improved charge injection device of FIG. 1A with the injection device being schematically shown in FIG. 3 in accordance with the illustration of FIG. 1B.

In FIG. 3, the RPM function unit is shown including a signal generating section 11 and a processing unit 12 such as shown in the previously identified pending application and patent, wherein a governor and trigger mechanism or a disc and interruptable air jet system satisfactorily develop a pair of pulse signals. In the present invention, the signal generating unit 12 is constructed to develop three output signals at three individual lines 15, 16 and 17. The signals at lines 15 and 16 are derived from a common, in-phase signal and line 16 includes a fluidic time delay element 18 to delay the transmission of the pulse signal from the unit 12.

The three signals are applied to a RPM function computing circuit 13 which is specially constructed in accordance with one feature of the present invention from a plurality of impacting stream fluidic devices to produce an amplified modulated pulse signal having a time width proportional to the RPM of the engine. The pulse signal is applied to a special amplifying section 14 which develops a pair of control signals applied to the charge injection device to control the impacting position and, thus, the fuel air charge supplied to the engine manifold in accordance with the RPM of the engine. In embodiment of FIG. 3, the port 5 is connected to the boosted pressure signal, which may be developed as disclosed in the previously identified patent, to further modulate the operation of the injection fluidic device 10 by futher modulating the strength of the main air stream.

In accordance with a particular aspect and feature of the embodiment as shown in FIG. 3, the RPM computing section 13 includes a first pair of two-input transverse impacting stream devices 21 and 22 interconnected as "Nor" logical units and further interconnected to define a fluidic "one-shot" flip-flop circuit. The transverse impact modulator 21 is shown with a pair of opposing main supply nozzles or stream sources which are connected to a suitable air supply such as any suitable air pump. The stream strengths are selected such that the impact is generally within a collecting chamber to develop an output logic pressure signal to an input port or nozzle 28 of the transverse modulator 22.

The signal nozzle 26 is connected to line 16 is series with time delay unit 18. A second nozzle 27 is located in opposed relation to the nozzle 26 and receives a signal from the transverse impact modulator 22. A signal at either one or both of the signal nozzles 26 and 27 effectively reduces the strength of the stream from the adjacent power nozzle and thereby develops a "Nor" logic output at the collector chamber. The output is normally logic 1 and is converted into a logic 0 in response to signals of either one or both of the nozzles 26 and 27.

The logic device 22 is generally similarly constructed with the signal nozzle, 28 connected to the output of the TIM divice 21 and having a second opposed nozzle 29 connected to the output of the signal line 15. The two signals selectively control the strength of the adjacent main stream relative to an opposed main stream. A collector adjacent the nozzle for the latter is constructed with a pair of output ports connected to port 27 of unit 21 and an input port 31 of the final stage device 23. The device 23 is generally similar to that of unit 21 with its opposing nozzles 30 and 31 connected respectively to output collector of the device 22 and to the signal line 17 and forms a fluidic substracting device. In operation, the output signal from the line 15 is applied to the nozzle 29 to activate the logic unit 22 of the flip-flop circuit which provides a logic 0 output signal via logic unit 23. The logic 1 signal applied via line 17 to the nozzle 30 holds logic unit 23 off and a logic 0 to the amplifying section 14. After a short period dependent upon RPM, the signal applied to the nozzle 30 drops to 0 and device 23 raises to a logic 1. After the time delay inserted by unit 18, a logic 1 is applied to nozzle 26 and reset the flip-flop circuit. The signal to the nozzle 31 of unit 23 rises to a logic 1 and cuts off the pulse output to produce of pulse width according to the speed of the engine. The output of the unit 12 recycles the logic circuit 13 to generate the signal in time spaced relation with each pulse width proportional to the speed of the engine. The fluidic one-shot unit establishes a fixed time period with the fluidic Nor device 23 switching occuring in response to the speed of the engine such that the pulse width varies with the speed of the engine. The use of the multiple input fluidic impacting stream devices 21, 22 and 23 permits significantly increasing of the amplification factor such that the air supply source can be at a low pressure but the power of the pulse signal can be high. It thereby allows a very highly satisfactory RPM related signal which is coupled to the power amplifying section 14 to further increase the power level for operating of the charge injection device 10.

Section 14 includes a first stage transverse impact modulator follower 24 (TIMF) having the pair of opposing power streams connected to the suitable air source. A common input-output chamber is mounted about the one nozzle and has an input port 32 connected to the output of the logic section 13 and an output port 32*a* connected as a control signal to the fluidic charge injection device 10 and also to a further fluidic amplifier shown as a transverse impact modulator 25.

The output of section 13 is connected directly via a line 32*b* to the transverse input nozzle 8 of the device 10. The same signal is applied to a transverse impact modulator unit 25 which provides an amplified, inverse output signal at line 02. The output of the signal at line 32*a* is applied to a nozzle 33 of device 25 and serves to deflect the air stream and allowing the supply air stream to move outwardly of the collector chamber, thereby reducing the strength of the stream transmitted as the input air stream to the fluidic injection device 10. This amplified air pressure signal is applied to the nozzle 1 of the fluidic injection device 10 in FIG. 3.

In summary, the RPM signal circuit produces a pair of signals operating inversely on the device 10 to simultaneously reduce the strength of the air stream from nozzle 1 as appears in the fluidic injection device 10. The signal transmitted via line 32*b* to nozzle 8 engages the air stream from nozzle 1 and cause deflection thereof to reduce its effective stream, allowing the fuel stream to move outwardly of the drain chamber 4 of device 10. The two signals derived from the follower amplifier 24 increase the total effectiveness of the signal stream and permit the controlling of the injection device 10 operating at a high power level and has been found to provide a highly improved and stabilized fluidic injection device for mounting within a manifold.

In FIG. 4, an embodiment of the invention is illustrated essentially similar to FIG. 3 with an air supply connection to the fluidic charge injection device 10. Thus, in FIG. 4, the air supply nozzle for the charge injection device 10 is connected directly to a suitable air supply $IN^2$ to establish a predetermined fixed pressure jet. The booster modifying signal is supplied to the main nozzle of the transverse impact modulator 25 such that the output signal $0^2$ is directly proportional thereto. The output of device 25, in turn, is connected directly to the signal chamber port 5 of the charge injection device 10 to modify the fixed air stream signal of nozzle 1 in accordance with the combination effect of the boosted pressure signal and the amplifier 25.

Figure 5:
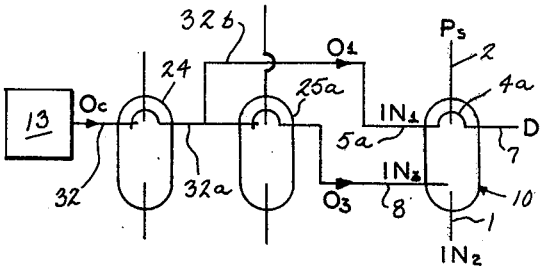
FIGS. 5–7 are similar to FIG. 4 and illustrate the charge injection unit of FIGS. 2A and 2B with different control signal connections.

In FIG. 5, a further embodiment is illustrated employing a fluidic charge injection device similar to that shown in FIGS. 2A and B, and an amplification section 14 which is constructed as shown in FIG. 3. The RPM signal at lines 32*b* is connected as the input to the port 5*a* and, thus, to the common input-drain chamber 4*a* of the charge injection device 10 to control the fuel supply stream. The output of the transverse impact modulator follower (TIMF) 25*a* is connected to the nozzle 8 for selectively deflecting the air stream from the nozzle 1 which may be connected to the boosted pressure signal or a fixed supply pressure signal as desired. In this embodiment, an increasing signal appearing at the output of the amplified stage 24 is directly applied to the fuel supply stream and increases its strength, thereby, tending to move the impact position outwardly to the charge position. The signal is increased by the TIMF 25*a*. This results in an increase in the strength of the air stream.

Figure 6:
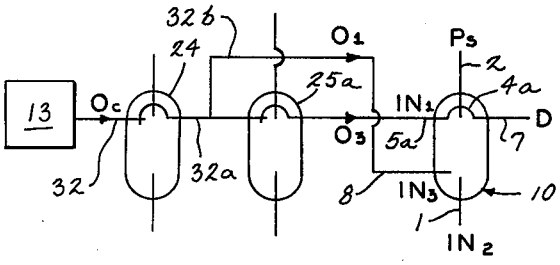

In FIG. 6, a similar fluidic charge injection device is illustrated in which the fluidic inverting device 25 is replaced with TIMF device. The output signal appearing at line 32*b* is connected directly to the deflection control nozzle 8. The TIMF device 25*a* couples the output of the line 32*a* signal to the port 5*a* of the common input-drain chamber 4*a* of the fluidic charge injection device 10. As the RPM signal increases at line 32*a*, it simultaneously applies an increased signal to the deflection nozzle 8 and to the common chamber 4*a*. The increased signal at the nozzle 8 causes deflection thereof permitting the fuel stream to move outwardly. Simultaneously, the increased strength of the fuel stream as a result of the increased input signal pressure combined therewith results in a further tendency to move the impact position outwardly with a corresponding increase fuel and air supply for firing of the engine. Conversely, when the signal decreases, it is simultaneously decreased at the common chamber and at the control nozzle. The decrease in the control nozzle signal allows the input stream to move into alignment with the fuel stream and cause it to move into the common input drain chamber. Simultaneously, the decrease in the input drain chamber results in a decrease in the effective strength of that stream and further causes the stream to move thereinto to lock it into the drain chamber.

Figure 7:
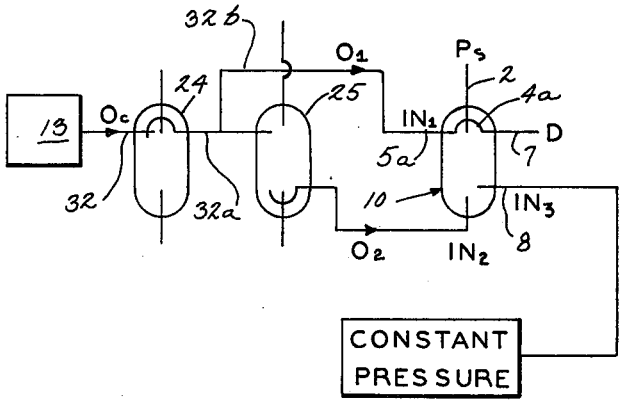

In FIG. 7, still another embodiment employing the fluidic charge unit of FIG. 1B is illustrated. The common input-drain chamber 4*a* is connected to the signal line 32*b*. In FIG. 7 an inverting device 25 coupled line 32*a* to the main nozzle $IN^2$ of the fluidic charge injection device 10. The controlled deflection nozzle 8 is connected to a steady constant pressure $IN^3$. In this embodiment of the invention, an increase in the RPM signal results in a simultaneous increased signal being applied to the input-drain chamber 4*a* and to the air nozzle $IN^2$. The increase signal of the fuel's chamber nozzle results in a corresponding balancing with the input being locked into the drain chamber. When the firing signal is received at $IN^3$, however, the air signal will be deflected and the fuel and air mixture will be introduced into the charge chamber. The amount of the fuel and the air will be directly proportional to the RPM signal. Thus, as the signal increases, both the fuel and the air signal increase. The deflection of the air signal, however, reduces its strength to permit the impacting position to move out into the charge chamber and, consequently, a greater amount of fuel and air are introduced into the manifold. Conversely, when the RPM signal decreases, the amount of air decreases while the amount of fuel increases to provide a richer proportion or mixture which is introduced into the chamber.

Various modes of carrying out the invention are contemplated as being within the scope of the following claims, particularly pointing out the distinctly claiming the subject matter which is regarded as the invention.

We claim:

1. In a fuel charge injection apparatus wherein an impacting stream charge injection device having a pair of opposing stream forming means to define impacting fuel and air streams and having means to move the impacting stream position therebetween for selective introduction into the engine, and having a signal source means to establish an engine related control signal for controlling at least one of said streams, comprising a stream control chamber means enclosing the discharge end of one of said stream forming means and having an orifice aligned with said stream forming means, and a control signal port connected to said chamber to receive said engine related control signal and to control the strength of the corresponding stream.

2. The fuel charge injection apparatus of claim 1 wherein said charge injection device operates at a high power level, and having a fluidic signal power amplifying means connected to said control signal port to amplify the power of said control signal.

3. The fuel charge injection apparatus of claim 2 wherein said fluidic signal power amplifying means includes an impacting stream follower means having an input means connected to receive the control signal and an output means establishing a constant pressure with flow.

4. The fuel charge injection apparatus of claim 3 wherein said signal source means coupled to the engine to generate a pair of time spaced low level control signals, pulse forming circuit comprising a first pair of fluidic amplifying devices adapted to switch between high and low outputs and each including a pair of inputs, said pair of fluidic amplifying devices being interconnected to form a fluidic dual input flip-flop gate means having a pair of input means connected to said signal source means to receive the first of said time spaced fluid signals with a delay means in said one impact means and having an output means, a fluidic subtracting device having a pair of inputs connected one to said output of the flip-flop gate means and the other of which is connected to said signal source means, said subtracting device being connected to said follower means.

5. The fuel charge injection apparatus of claim 4 wherein said pair of fluidic amplifying devices are transverse impact modulators having a pair of opposing power streams and a pair of control streams forming means coupled to one stream which is effectively cut-off in response to the presence of either one or both of the control streams, and said fluidic subtracting device is a corresponding transverse impact modulator having said control stream forming means connected to said flip-flop gate means and to said signal source.

6. The fuel charge injection apparatus of claim 3 wherein said charge injection device includes a stream control means for controlling one of said streams, a fluidic modulator means, and said follower means having a first output means and a second output means connected to said fluidic modulator means and said chamber means and said stream control means connected one each to said first output means and to said fluidic modulator means.

7. The fuel charge injection apparatus of claim 6 wherein said fluidic modulator means is a transverse impact modulator having a control input connected to said follower means and an output means connected to said charge injection device.

8. The fuel charge injection apparatus of claim 7 wherein said charge injection device includes a transverse signal nozzle, and said first output means of said follower means and the output means of the fluidic modulator means are connected to said control chamber and to said transverse signal nozzle.

9. The fuel charge injection apparatus of claim 6 wherein said fluidic modulator means is a fluidic impacting stream follower means having a common input-output means connected to said first named follower means and to said charge injection device.

10. The fuel charge injection apparatus of claim 9 wherein said charge injection device includes a transverse signal nozzle, and said first output means of said follower means and the output means of the fluidic modulator means are connected to said control chamber and to said transverse signal nozzle.

11. The fuel charge injection apparatus of claim 1 wherein said one of said stream forming means of said charge injection device produces a fuel stream and the other produces an air stream, said stream control chamber means enclosing the stream forming means for the fuel stream and having an output port connected to return fuel to a supply.

12. The fuel charge injection apparatus of claim 1 wherein said one of said stream forming means of said charge injection device produces a fuel stream and the other produces an air stream, said stream control chamber means enclosing the stream forming means for the air stream, and having a drain chamber enclosing the stream forming means fo the fuel stream, said drain chamber having a fuel return port for recycling of the fuel.

* * * * *

UNITED STATES PATENT AND TRADEMARK OFFICE

CERTIFICATE OF CORRECTION

PATENT NO. : 4,031,870

DATED : June 28,1977

INVENTOR(S) : SHINJI OZAWA

It is certified that error appears in the above-identified patent and that said Letters Patent are hereby corrected as shown below:

| | | | | |
|---|---|---|---|---|
| [56] References Cited, | | Line | 8, | Cancel "3,556,063" and insert --- 3,556,003 ---; |
| Column | 1, | Line | 29, | before "engine" cancel "a" and insert --- and ---; |
| Column | 2, | Line | 15, | before "modulator" cancel "impct" and insert --- impact ---; |
| Column | 2, | Line | 37, | before "subtracting" insert --- a ---; |

UNITED STATES PATENT AND TRADEMARK OFFICE

CERTIFICATE OF CORRECTION

PATENT NO. : 4,031,870
DATED : June 28, 1977
INVENTOR(S) : SHINJI OZAWA

It is certified that error appears in the above-identified patent and that said Letters Patent are hereby corrected as shown below:

...continued...

| | | | | |
|---|---|---|---|---|
| Column | 3, | Line | 57, | after "within" cancel "maifold" and insert --- manifold ---; |
| Column | 8, | Line | 8, | before "distinctly" cancel "the" and insert --- and ---; |
| Column 10 CLAIM 12 | | Line | 18, | after "means" cancel "fo" and insert --- for ---. |

Signed and Sealed this

*Eighteenth* Day of *October 1977*

[SEAL]

*Attest:*

RUTH C. MASON
*Attesting Officer*

LUTRELLE F. PARKER
*Acting Commissioner of Patents and Trademarks*